US008113612B2

(12) United States Patent
Levy et al.

(10) Patent No.: US 8,113,612 B2
(45) Date of Patent: Feb. 14, 2012

(54) INK DELIVERY SYSTEM

(75) Inventors: Andrew B. Levy, West Linn, OR (US); Greg K. Justice, Vancouver, WA (US); Ricardo G. Diaz, Vancouver, WA (US); Chris Arnold, Vancouver, WA (US); Mark A. DeVries, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 380 days.

(21) Appl. No.: 12/394,547

(22) Filed: Feb. 27, 2009

(65) Prior Publication Data

US 2010/0220127 A1 Sep. 2, 2010

(51) Int. Cl.
*B41J 29/38* (2006.01)
*B41J 29/393* (2006.01)
*B41J 2/17* (2006.01)

(52) U.S. Cl. ..... 347/6; 347/19; 347/84

(58) Field of Classification Search ..... 347/5–6, 347/84–87, 19
See application file for complete search history.

(56) References Cited

U.S. PATENT DOCUMENTS

| | | | | |
|---|---|---|---|---|
| 5,880,748 | A | 3/1999 | Childers et al. | |
| 6,000,788 | A | 12/1999 | Iida | |
| 6,137,513 | A | 10/2000 | Pawlowski, Jr. et al. | |
| 6,193,364 | B1 | 2/2001 | Iida | |
| 6,302,531 | B1 | 10/2001 | Usui et al. | |
| 6,550,901 | B2 | 4/2003 | Iida | |
| 6,648,459 | B2 | 11/2003 | Usui et al. | |
| 7,090,341 | B1 | 8/2006 | Miyazawa | |
| 7,237,572 | B2 | 7/2007 | Haines et al. | |
| 7,467,858 | B2 | 12/2008 | Lebron et al. | |
| 7,559,634 | B2 * | 7/2009 | Miyazawa | 347/84 |
| 2006/0090801 | A1 | 5/2006 | Haines et al. | |
| 2009/0027461 | A1 * | 1/2009 | Asada | 347/85 |

* cited by examiner

*Primary Examiner* — Julian Huffman
*Assistant Examiner* — Jason Uhlenhake
(74) *Attorney, Agent, or Firm* — Nathan R. Rieth

(57) ABSTRACT

An ink delivery system includes a plurality of ink supplies, an air pressure source to generate ink pressure for each ink supply, an ink valve associated with each ink supply, where each ink valve is configured to prevent a reverse flow of ink from a pen to the associated ink supply, and each ink valve has a switch configured to provide an open signal when the ink valve is open, and a controller configured to determine one of a normal ink condition, an out of ink condition or a system pressure problem based on receiving the open signals and to regulate the pressure source according to the determination.

5 Claims, 10 Drawing Sheets

INK DELIVERY SYSTEM

BACKGROUND

Conventional ink-jet printers utilize a carriage that carries one or more ink-jet printheads in a scanning motion that is perpendicular to the direction of the printer paper path. The printheads scan the page while ejecting ink droplets to form the desired image. In a page-wide-array printer, a page-wide-array ("PWA") printhead spans an entire pagewidth (e.g., 8.5 inches) and has many more ink nozzles than the scanning-type printheads. The PWA printhead is fixed on a print bar that is typically oriented orthogonally to the paper path. The page moves relative to the fixed PWA printhead as the printhead prints one or more lines at a time of the desired image.

Ink-jet printers often include stationary ink reservoirs connected to the printheads through tubes. These printers are generally called "off-axis" printers, as the external reservoirs are typically known as "off-axis" ink reservoirs. Many off-axis printers have pressurized ink supplies that enable higher flow rates of supply ink to the printheads. A supply may be pressurized by an external source such as an air pump, or it may be a self-pressurized supply that contains a propellant and remains pressurized at all times. In either case the pressure source is used to pressurize the supply's ink.

Pressurized ink supplies provide significant advantages in transferring ink from the supplies to the printheads in required time limits. However, challenges remain with respect to regulating the pressure and the ink associated with pressurized ink supplies.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
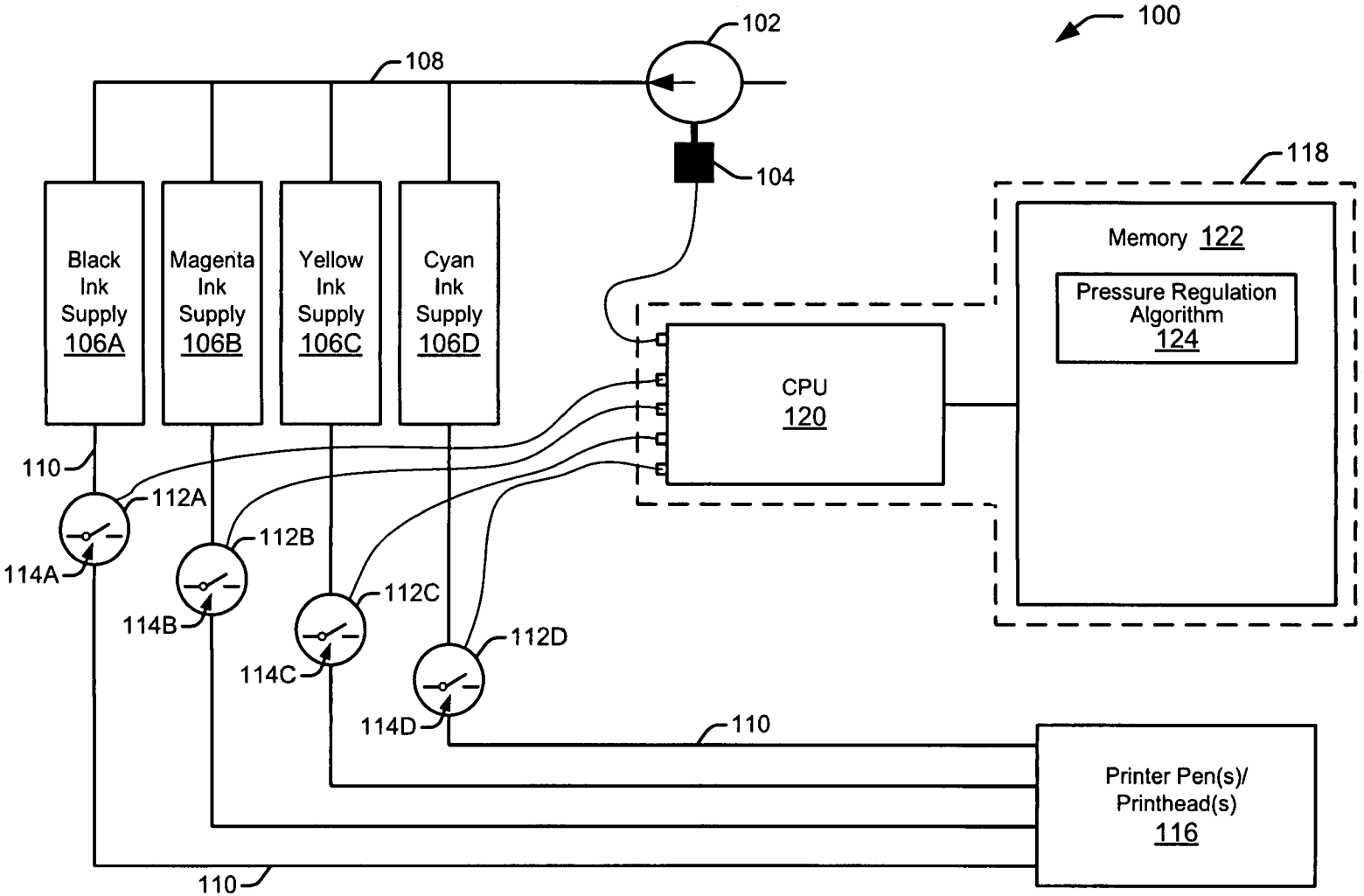
FIG. 1 shows an example of an ink supply system according to an embodiment.

As noted above, there are challenges that remain in regulating the pressure and ink in pressurized ink supplies. One issue inherent to pressurized ink supply systems is the back pressure (a negative pressure) exerted by the ink container on the ink that occurs when the air pressure applied as the motive force is removed and the driving side of the system is allowed to return to atmospheric pressure. Although pressurized ink supply systems regulate upstream ink pressure to the printheads (pens), the regulators do not work in reverse. When a negative pressure is applied, a regulator can open completely, applying a high back pressure condition to the pen orifices. The back pressure can result in air being pulled into the ink orifices, filling the pen firing chambers and causing a "de-prime" condition. De-prime can, depending on other systems that are designed to maintain nozzle health, cause complete failure of the pen. The effect of back pressure is even more apparent when the ink container nears depletion. Therefore, regulating system pressure and determining when a low ink or an out of ink condition occurs have been challenging problems to solve with pressurized ink supply systems.

Various solutions to these problems have been developed. For example, there have been a number of different devices and techniques employed for determining when an ink container is low on ink or is out of ink. Optical sensors, air-ink sensors, capacitance sensors, mechanical sensors, and drop counting are among these devices and techniques. These solutions have disadvantages, however, such as the need for complex algorithms, additional complex electronics, and extensive characterization experiments to adequately predict low on ink and out of ink behavior in the ink supply.

In regulating the pressure source, prior pressurized ink supply systems have utilized expensive pressure transducers. For example, these systems often utilize high quality pressure transducers to monitor and control an air pump, and they frequently contain separate transducers to monitor the difference between the ink pressure and the system pressure. Some pressurized supplies contain smaller, less expensive pressure transducers to directly measure the difference between the system air pressure and ink pressure. However, ink compatibility issues have plagued these systems and have lead to additional problems.

Other systems have moved the ink pressure transducers off of the supply and into the printer. These systems have the same disadvantages listed above. In general, pressure transducer based systems are expensive and burden the consumer with a higher cost for the print mechanism or ink supplies or both.

Embodiments of the present disclosure overcome disadvantages associated with the use of various complex sensors and expensive pressure transducers like those noted above. In one embodiment, for example, an ink delivery system includes a plurality of ink supplies, an air pressure source to generate ink pressure for each ink supply, and an ink valve associated with each ink supply. Each ink valve is configured to prevent a reverse flow of ink from a pen to the associated ink supply, and each ink valve includes a switch configured to provide an open signal when the ink valve is open. In this embodiment the ink delivery system also includes a controller configured to determine a normal ink condition, an out of ink condition or a system pressure problem based on receiving the open signals from the switches. The controller regulates the pressure source based on its determination of a normal ink condition, an out of ink condition or a system pressure problem.

In another embodiment, an ink delivery system includes a plurality of ink supplies, an air pressure source, an ink valve associated with each ink supply, and a controller as noted above. The ink delivery system in this embodiment also includes a system pressure switch configured to close when system air pressure from the air pressure source reaches a threshold. In this embodiment the controller is further configured to determine a low ink condition in an ink supply when a corresponding ink valve opens after the system pressure switch closes.

In still another embodiment an ink delivery system includes a plurality of ink supplies, an air pressure source, an ink valve associated with each ink supply, and a controller as noted above. In this embodiment, the ink supplies are self-pressurized supplies. The ink delivery system in this embodiment also includes first stage regulators associated with each pressurized ink supply in order to regulate the ink pressure from a propellant pressure to an ink system pressure.

In another embodiment, a method of regulating ink supply pressure in an ink delivery system includes initiating an air pressure source, monitoring ink valve switches to determine a system pressure problem, a normal ink condition, and an out of ink condition, and then regulating the air pressure source based on which problem or condition is determined.

In another embodiment, a method of regulating ink supply pressure in an ink delivery system includes initiating an air pressure source, monitoring ink valve switches and a system pressure switch to determine a system pressure problem, a normal ink condition, an out of ink condition or a low ink condition, and then regulating the air pressure source based on which problem or condition is determined.

In another embodiment, a method of regulating ink supply pressure in an ink delivery system having self-pressurized supplies includes engaging first stage regulators, monitoring ink valve switches and the first stage regulators to determine a system pressure problem, a normal ink condition and an out of ink condition and then regulating the air pressure source through controlling the first stage regulators according to which problem or condition is determined.

First Illustrative Embodiment

FIG. 1 shows an example of an ink delivery system 100 according to an embodiment of the present disclosure. Ink delivery system 100 may operate, for example, in a conventional ink-jet printer, a page-wide-array printer, or the like. The system 100 includes an air pressure source (e.g., air pump) 102 with a motor feedback signal mechanism 104. The air pressure source 102 is coupled to, and provides air pressure to, a plurality of ink supplies 106 via air tubing 108. In FIG. 1 there are four ink supplies 106 illustrated; a black ink supply 106A, a magenta ink supply 106B, a yellow ink supply 106C, and a cyan ink supply 106D. Although four ink supplies 106 are illustrated, the illustration is made by way of example only, and it is to be understood that different ink delivery systems may employ a greater or lesser number of ink supplies.

Figure 2A:
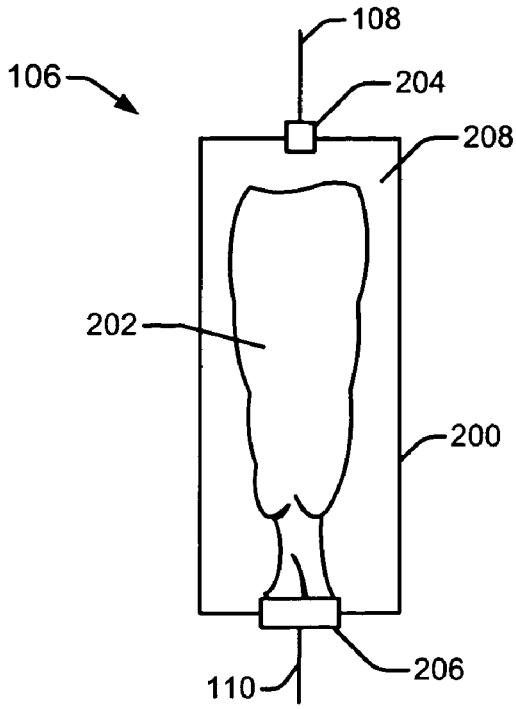
FIG. 2A shows an example of an ink supply according to an embodiment.

Different embodiments of the ink supplies 106 of FIG. 1 will now be discussed briefly with reference to FIGS. 2A and 2B. As shown in FIG. 2A, an ink supply 106 includes a rigid outer container or housing in the form of a canister 200. Each canister 200 contains an internal flexible container in the form of an ink bladder 202 that contains a quantity of ink. Each canister 200 includes an air input port 204 coupled to air tubing 108 to receive pressurized air from air pressure source 102. Each canister also includes an ink output port 206 to which the internal ink bladder 202 is connected such that ink can flow out of the ink bladder and into the ink tubing 110 as pressure within the canister increases within the interstitial volume 208 between the canister 200 and the bladder 202.

Figure 2B:
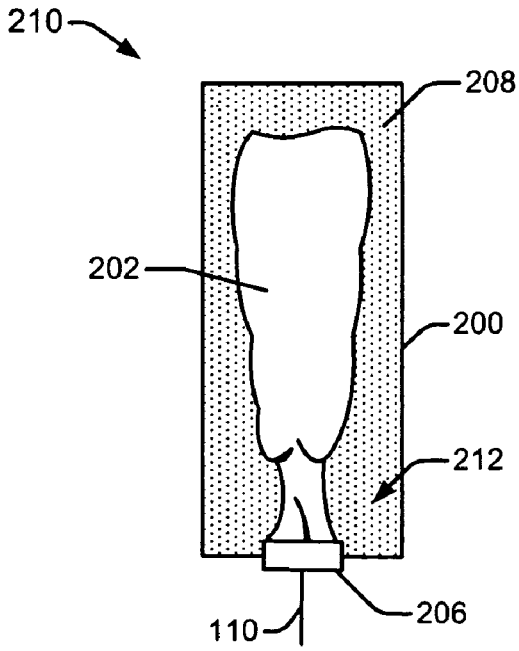
FIG. 2B shows an example of a self-pressurized ink supply according to an embodiment.

In FIG. 2B, an alternate form of an ink supply 106 is illustrated. In FIG. 2B, the alternate ink supply is a self-pressurized supply 210 that contains a propellant and remains pressurized continuously. This self-pressurized supply 210 is appropriate for use in an alternate embodiment of an ink supply system such as that discussed below with reference to FIG. 5. The self-pressurized ink supply 210 is not coupled to an air pressure source 102 through air tubing 108. It therefore does not include an air input port 204. Rather, self-pressurized ink supply 210 contains a propellant 212 arranged within the interstitial volume 208 between the canister 200 and the bladder 202. The propellant 212 maintains pressure on the bladder 202. A suitable propellant 212 is a compressed gas such as compressed nitrogen. The compressed gas gives a stable pressure over a wide temperature range.

Referring again to FIG. 1, coupled between each ink supply 106 and one or more printer pens (printheads) 116 via ink tubing 110, is an ink valve 112 (ink valves 112A-112D). Each ink valve 112 is configured to prevent a reverse flow of ink from a pen (printhead) 116 to its associated or corresponding ink supply 106. For example, ink valve 112A prevents a reverse flow of ink from a pen (printhead) 116 to ink supply 106A. A reverse flow of ink can occur when the ink bladder 202 is almost empty and the interstitial volume 208 between the canister 200 and the ink bladder 202 is depressurized. In this circumstance the depressurized bladder 202 will move from a collapsed state to a free state which can pull ink from the pens 116 back into the supplies 106. This is an example of a reverse flow of ink that the ink valve 112 can prevent.

Figure 3A:
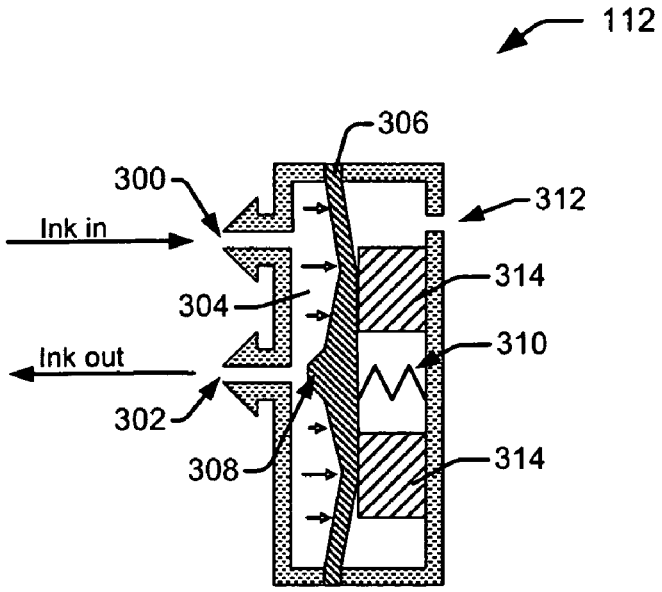
FIG. 3A shows an example of an ink valve in an ink supply system according to an embodiment.

FIG. 3A illustrates an embodiment of an ink valve 112. Ink valve 112 includes ink inlet port 300 (a non-sealed port) and ink outlet port 302 (a sealed port) to allow ink to flow in and out of valve 112. Ink from a pressurized ink supply 106 flows in the non-sealed port into valve chamber 304 and out the sealed port. A diaphragm 306 includes a bump or other sealing feature 308 to seal outlet port 302 when valve 112 is closed. An elastic object such as a spring 310 is used to push seal 306 against outlet port 302 to close valve 112. The non-ink containing side of valve 112 is open to the atmosphere via vent hole 312, and stops 314 relieve tension in diaphragm 306.

When an ink supply 106 is pressurized, the ink in valve chamber 304 is also pressurized because the open inlet port 300 of valve 112 is connected to the pressurized ink supply line 110. This pressure forces diaphragm 306 to move, and seal 308 moves off or away from outlet port 302, opening valve 112. The ink then flows freely through valve 112.

In the embodiment of the ink delivery system 100 illustrated in FIG. 1, each ink valve 112 is configured with an ink valve switch 114 (switches 114A-114D). Switch 114 is configured to trigger (e.g., close) when ink pressure moves diaphragm 306 and breaks the seal 308 away from outlet port 302, opening valve 112. When switch 114 triggers (e.g., closes), it provides an "open signal" indicating that ink valve 112 has opened. Switch 114 can be configured as various types of switches, and is not limited by the embodiments described herein. For example, switch 114 may be configured as an opto-sensor switch, a contact switch or a hall effect switch.

Figure 3B:
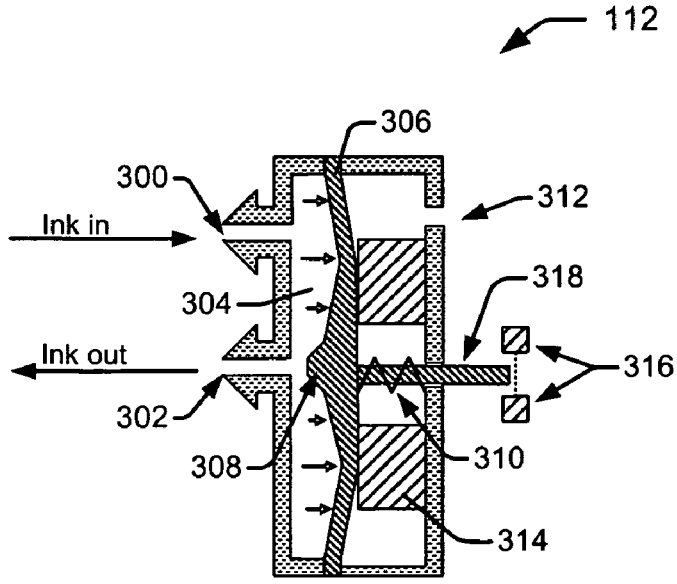
FIG. 3B shows an example of an ink valve with a switch in an ink supply system according to an embodiment.
Figure 3C:
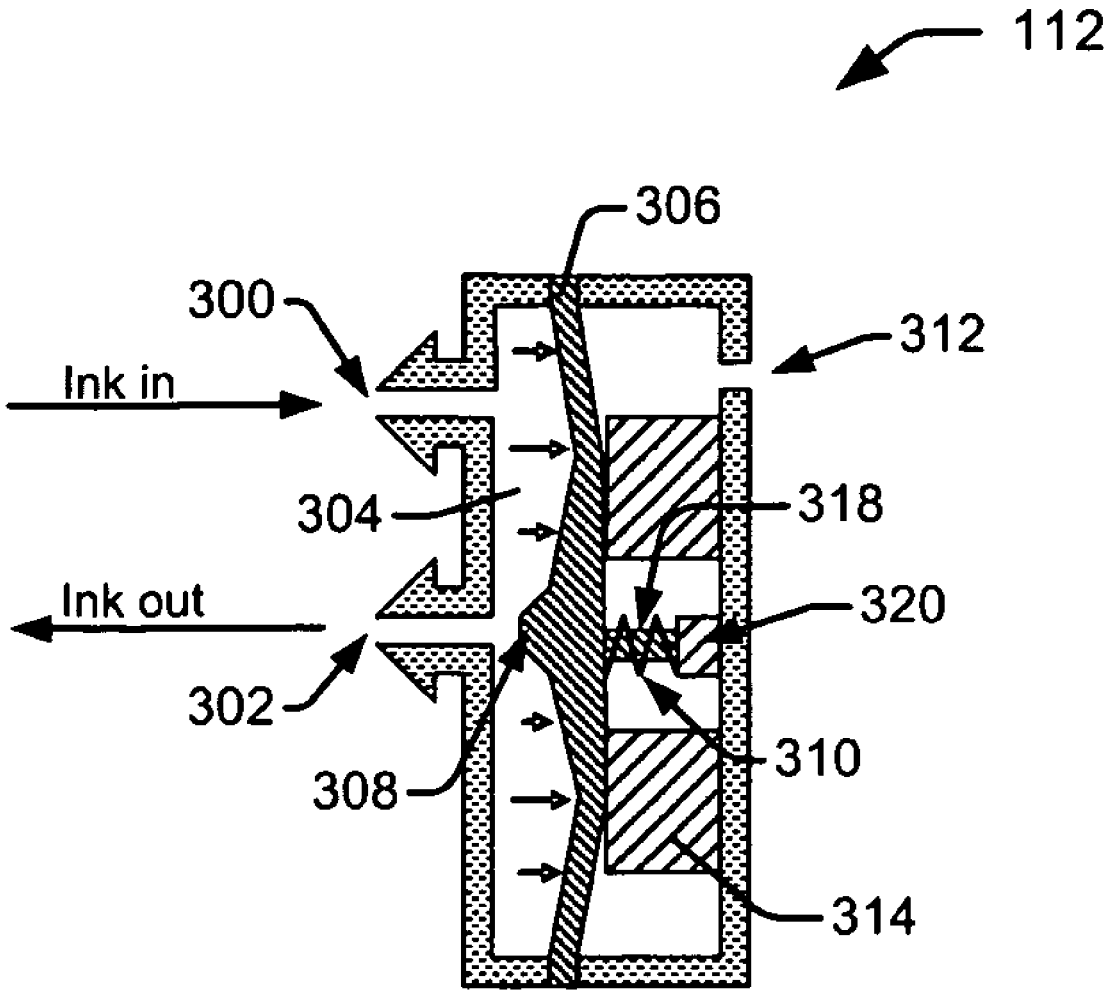
FIG. 3C shows an example of an ink valve with another switch in an ink supply system according to an embodiment.

FIGS. 3B and 3C illustrate ink valves 112 with two different exemplary embodiments of a switch 114. In FIG. 3B, ink valve 112 includes an opto-sensor switch 316 that is triggered (e.g., it closes) when it senses, via a diaphragm flag 318, enough movement of diaphragm 306 to open valve 112. The diaphragm flag 318 is coupled to diaphragm 306 such that when ink pressure forces diaphragm 306 to move, breaking the seal 308 away from outlet port 302 and opening valve 112, the opto-sensor switch 316 is triggered (e.g., the switch 316 closes). Opto-sensor switch 316 senses movement of the diaphragm 306 through corresponding movement of the diaphragm flag 318.

Referring to FIG. 3C, ink valve 112 includes a contact switch 320 that is triggered (e.g., it closes) when it senses, via diaphragm flag 318, enough movement of diaphragm 306 to open valve 112. The diaphragm flag 318 is coupled to diaphragm 306 such that when ink pressure forces diaphragm 306 to move, breaking the seal 308 away from outlet port 302 and opening valve 112, the contact switch 320 is triggered (e.g., the switch 320 closes). Contact switch 320 senses movement of the diaphragm 306 through corresponding movement of the diaphragm flag 318.

Referring again to FIG. 1, a controller 118 is configured to regulate the air pressure source (e.g., air pump) 102. Controller 118 includes a processor (CPU) 120 and memory 122. Processor 120 is a hardware device for executing software that can be stored in memory 122. Processor 120 can be any custom-made or commercially available processor, including a central processing unit (CPU), an auxiliary processor among several processors associated with ink delivery system 100 within a printer, or a semiconductor-based microprocessor (in the form of a microchip). When the ink delivery system 100 is in operation, the processor 120 is configured to execute software stored within memory 122, to communicate data to and from the memory 122, and to generally control operations of the ink delivery system 100.

Memory 122 can include any one or combination of volatile memory elements (e.g., random access memory (RAM, such as dynamic RAM or DRAM, static RAM or SRAM, etc.)) and nonvolatile memory elements (e.g., read-only memory (ROM), drives, discs, etc.). Memory 122 may contain data files and various software application programs, each of which typically comprises an ordered listing of executable instructions for implementing logical functions. In the illustrated example, the software in memory 122 includes pressure regulation algorithm 124 configured to execute on processor 120 and cause controller 118 to regulate air pump 102.

The controller 118, through execution of algorithm 124 on processor 120, regulates air pump 102 in part based on the "open signals" it receives from switches 114. Based on the open signals, controller 118 determines different conditions and/or problems that may exist within ink delivery system 100 and regulates air pump 102 accordingly. For example, during the execution of algorithm 124, controller 118 initiates air pump 102 and then monitors the ink valve switches 114 for open signals. If it receives open signals from all of switches 114 prior to a preset time period elapsing from the initiation of the pump 102, it determines that a normal ink condition exists. The controller 118 then waits for a second time period and stops the pump. If the controller 118 receives open signals from less than all of switches 114 prior to the preset time period elapsing from initiation of the pump 102, it determines that one or more ink supplies is out of ink and stops the pump to inform the user. If the controller 118 receives no open signals from switches 114 prior to the preset time period elapsing from initiation of the pump 102, it determines that a system pressure problem exists and it stops the pump and informs the user. The operation of the controller 118 regarding algorithm 124 is discussed in greater detail below with respect to embodiments of methods for regulating the ink supply pressure.

Second Illustrative Embodiment

Figure 4:
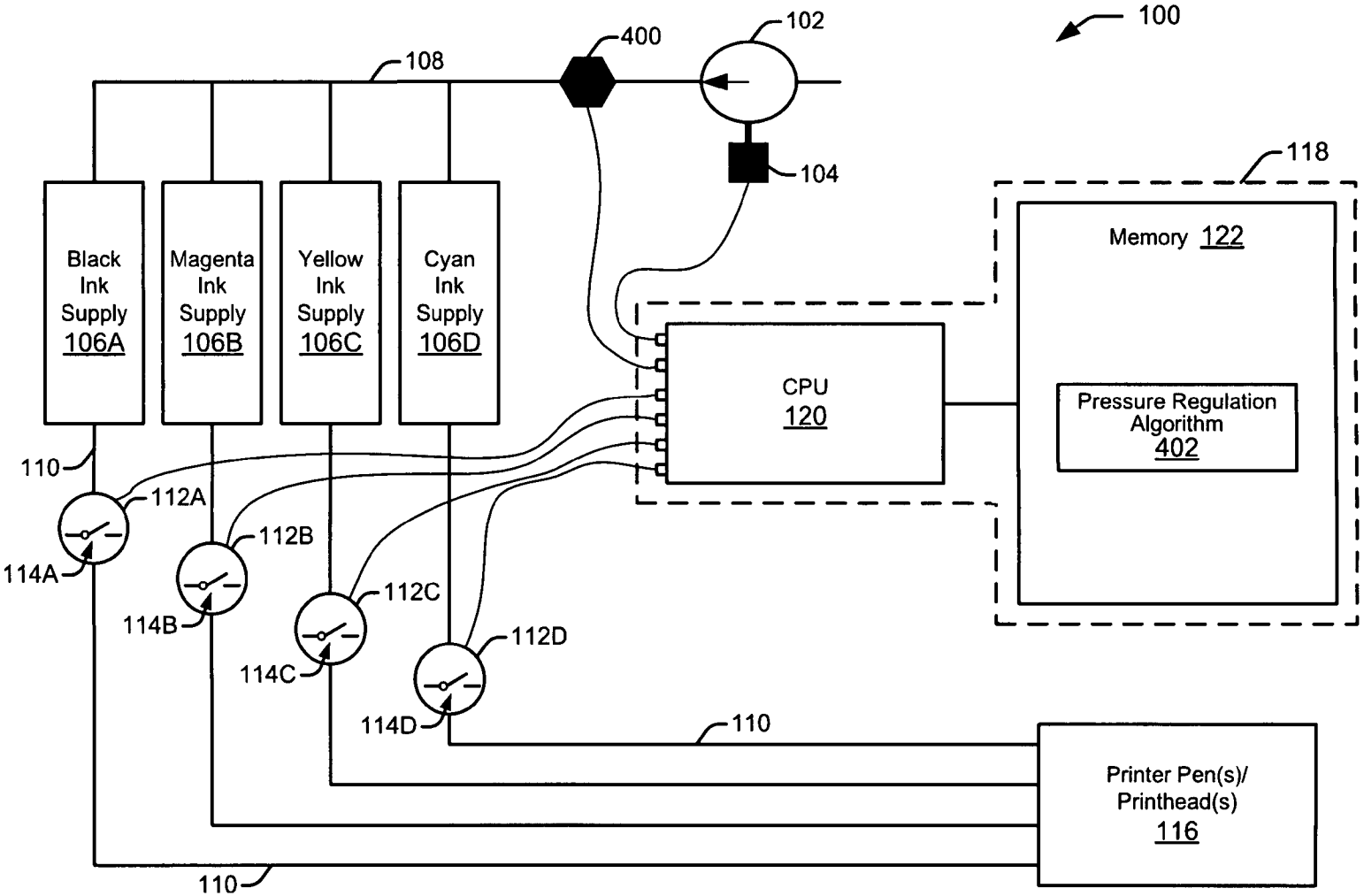
FIG. 4 shows another example of an ink supply system including a pressure switch according to an embodiment.

FIG. 4 shows another example of an ink delivery system 100 according to an embodiment of the present disclosure. The system 100 is similar to the embodiment discussed with reference to FIG. 1, except that it additionally includes a pressure switch 400 and a different algorithm 402 stored in memory 122. Pressure switch 400 provides a trigger (e.g., closes) when air pressure in air tubing 108 reaches a preset system air pressure threshold. Use of the pressure switch enables controller 118 to make an additional determination regarding a low ink condition in an ink supply 106. That is, based on the open signals from ink valve switches 114 and an additional trigger from pressure switch 400, controller 118 can determine a normal ink condition, an out of ink condition, a low ink condition and a system pressure problem existing within ink delivery system 100, and regulate air pump 102 accordingly.

The basis for determining a low ink condition in a supply 106 is that the corresponding valve 112 does not open until after a higher threshold system air pressure is reached (i.e., triggering the pressure switch 400). That is, in a supply 106 that has low ink, a higher system air pressure is needed to generate enough ink pressure to open the corresponding valve 112. When determining a low ink condition, the execution of algorithm 402 on processor 120 causes controller 118 to initiate air pump 102, and then to monitor the ink valve switches 114 for open signals, and the pressure switch 400 for a trigger. If, prior to the preset time period elapsing from initiation of the pump 102, the controller 118 receives an open signal from switches 114 but one or more of the switches does not open until after the pressure switch 400 is triggered, then the controller determines which switches 114 opened-after the pressure switch 400 triggered and notifies the user that the ink supplies 106 corresponding to those switches 114 have a low ink condition. The operation of the controller 118 regarding algorithm 402 is discussed in greater detail below with respect to embodiments of methods for regulating the ink supply pressure.

Third Illustrative Embodiment

Figure 5:
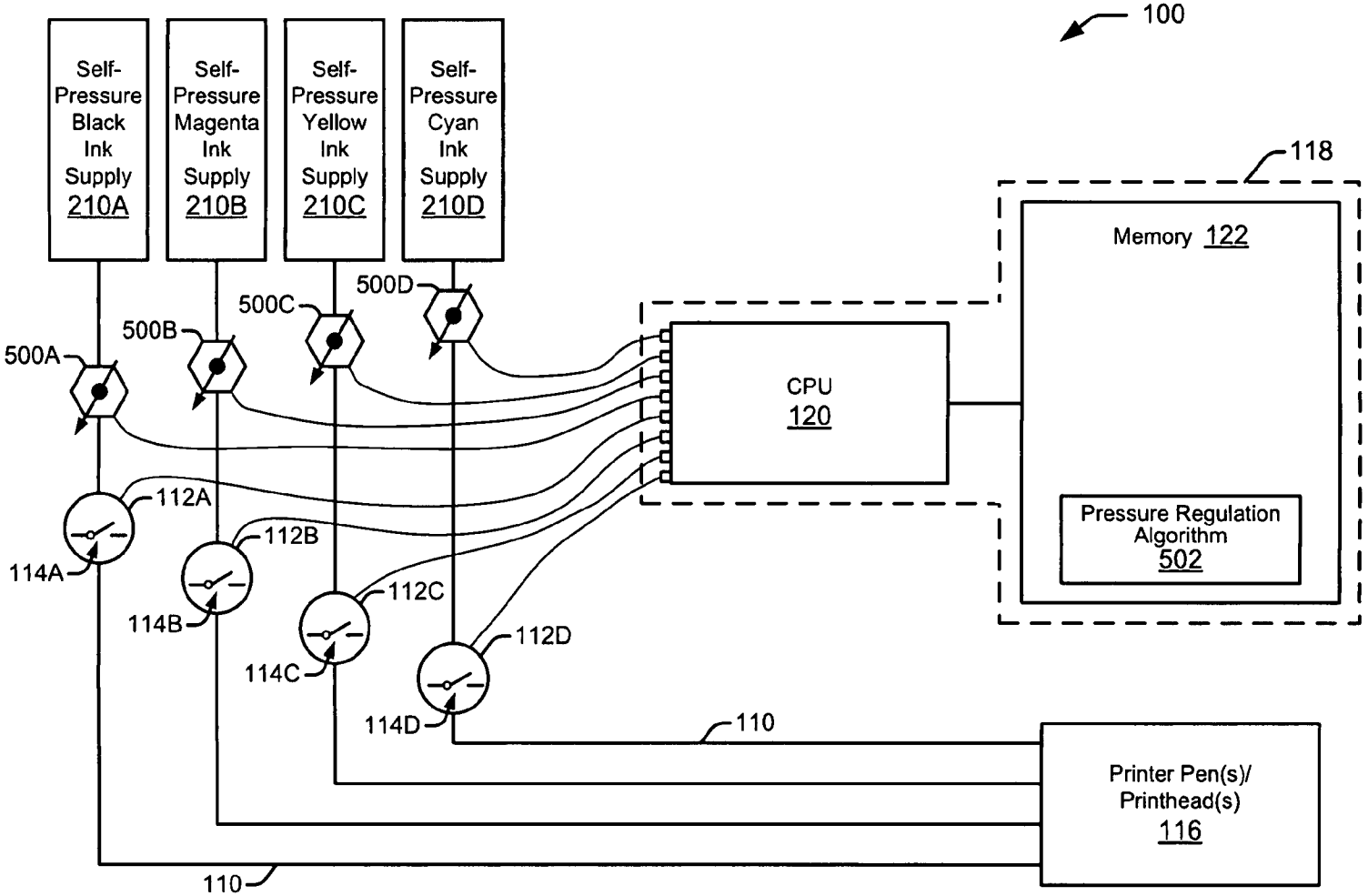
FIG. 5 shows another example of an ink supply system having self-pressurized ink supplies according to an embodiment.

FIG. 5 shows another example of an ink delivery system 100 according to an embodiment of the present disclosure. The system 100 is similar to the embodiment discussed with reference to FIG. 1, except that the ink supplies are self-pressurized supplies 210 (210A-210D) such as those discussed above with respect to FIG. 2B. In addition, the system 100 of FIG. 5 includes first stage regulators 500 (500A-500D) located between each of the self-pressurized supplies 210 and their corresponding ink valves 112. The first stage regulators 500 are used to reduce the ink pressure from propellant pressure (i.e., the pressure from the propellant 212 within the self-pressurized supplies 210) to an ink system pressure. The regulators 500 can engage and disengage in order to isolate the self-pressurized supplies 210 from the system 100.

The controller 118 also executes a different algorithm 502 on processor 120, and thereby regulates pressure from self-pressurized supplies 210 in part based on the "open signals" it receives from switches 114 and further based on regulator feedback signals from regulators 500. Based on the open signals, controller 118 determines different conditions and/or problems that may exist within ink delivery system 100 and controls regulators 500 accordingly. When algorithm 502 is initiated, controller 118 engages the first stage regulators 500 and then monitors the ink valve switches 114 for open signals. If the controller 118 does not receive an open signal from any of the switches 114 prior to a preset time period elapsing from engaging the regulators 500, it determines there is a system pressure problem due to an error in regulators 500 and/or all of the supplies 210 are out of ink, and it disengages the regulators 500 and informs the user of an error. If the controller 118 receives an open signal from all of switches 114 prior to a preset time period elapsing from engaging the regulators 500, it determines that a normal ink condition exists and that the system is operating at adequate pressure. If the controller 118 receives open signals from at least one but not all of switches 114 prior to a preset time period elapsing from engaging the regulators 500, it checks the regulator feedback signals to determine if there is a problem regulating pressure from any of the ink supplies 210. If there is a problem, the controller 118 disengages the regulators 500 and informs the user of an out of ink condition in the ink supply 210 whose regulator 500 had the error. The operation of the controller 118 regarding algorithm 502 is discussed in greater detail below with respect to embodiments of methods for regulating the ink supply pressure.

Fourth Illustrative Embodiment

Figure 6:
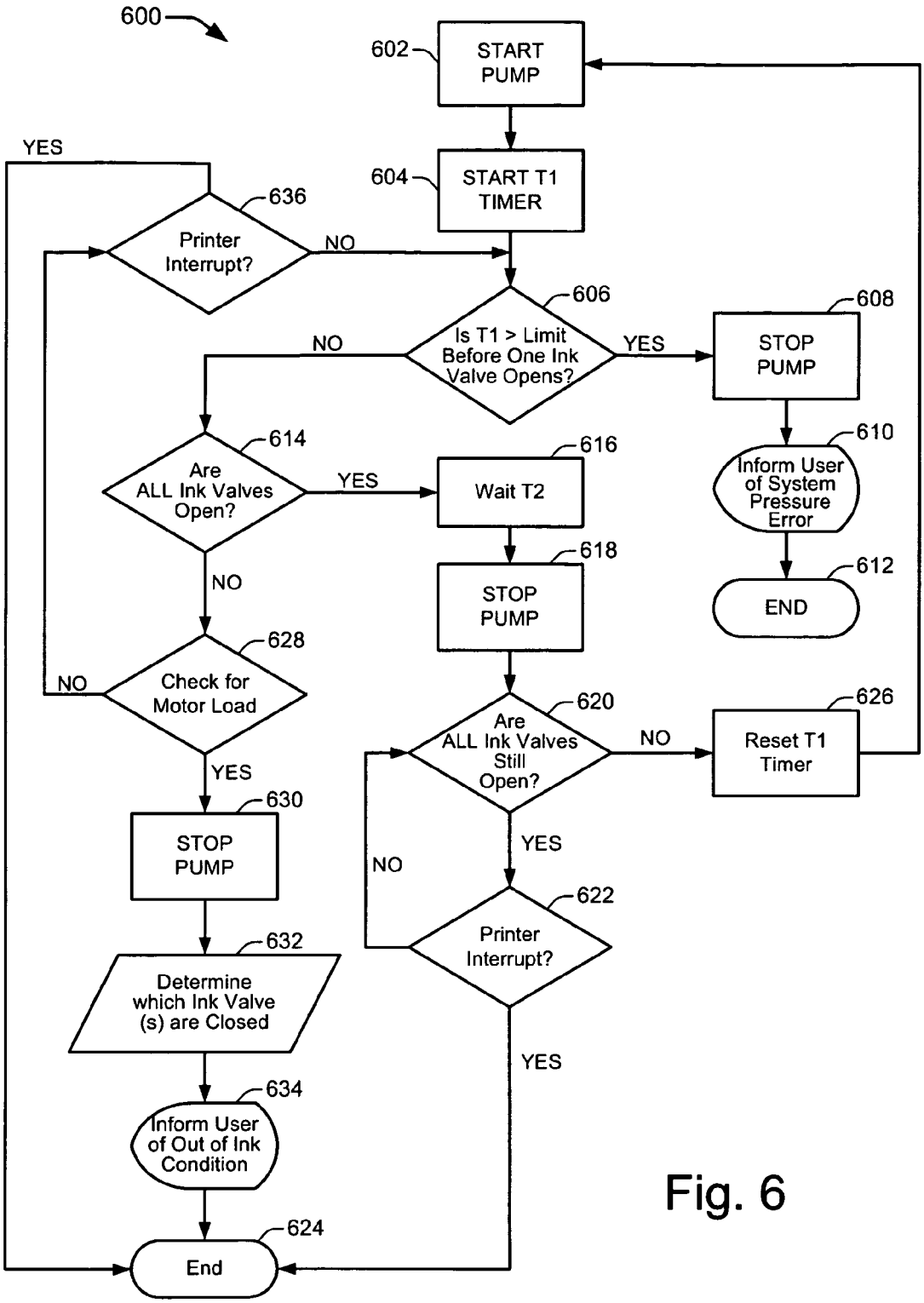
FIG. 6 shows a flowchart of a method of regulating an ink supply system according to an embodiment.

FIG. 6 shows a flowchart of a method 600 of regulating an ink supply system 100 according to an embodiment. Method 600 is associated with the ink delivery system 100 of FIG. 1 and the execution of algorithm 124 on processor 120 to manage the controller 118 in regulating the ink supply system 100, as discussed briefly above. Method 600, through the execution of algorithm 124 on processor 120, operates to determine a normal ink condition, an out of ink condition, or a system pressure problem in ink supply system 100 and to regulate the system accordingly. References made to ink delivery system 100 in the following description of method 600 therefore refer to the FIG. 1 embodiment of ink delivery system 100.

Referring to FIG. 6, method 600 begins at block 602 when the air pressure source (e.g., air pump) 102 is turned on, for example by controller 118 executing a firmware command when a host printer receives a print job. At the same time, as shown at block 604, a timer is started to keep track of an elapsed time T1. At decision block 606, controller 118 determines whether the elapsed time T1 has exceeded a preset time limit before an ink valve 112 has opened. The preset time limit is typically determined based on the torque of the air pump motor 102 and the current protection mechanisms in the pump motor 102 that limit the amount of time the pump can run on a continuous basis.

In making its determination at decision block 606, the controller 118 monitors a plurality of ink valve switches 114 within respective ink valves 112 and receives an "open signal" from a switch 114 when the switch senses the opening of its respective ink valve 112. The "open signal" is typically indicated by a closure of the switch 114, but may also be indicated by an opening of the switch 144, depending on the switch configuration. At block 606, if controller 118 determines that the elapsed time T1 has exceeded the preset limit before even one ink valve opens, then the air pump 102 is stopped, as shown at block 608. The user is then informed of a system pressure error at block 610. A system pressure error indicates a system pressure problem that may be caused by a leak in a hose (e.g., air tubing 108) or by a hose that has become unattached and is open, etc. After the user is informed of the system pressure error, the method 600 ends at block 612.

Referring again to decision block 606, if controller 118 determines that the elapsed time T1 has not exceeded the preset limit before even one ink valve opens, then the controller 118 checks all the ink valve switches 114 for "open signals" to determine if all the ink valves 112 are open, as shown at decision block 614. If all the ink valves 112 are open then the controller 118 determines that a normal ink condition exists within system 100, and it waits an additional period of time T2 and stops the air pump 102, as shown at blocks 616 and 618, respectively. The controller 118 then performs a loop between decision block 620 and decision block 622, continually checking to see if all the ink valves 112 are still open while also checking for a printer interrupt. If all the ink valves 112 remain open at block 620 and the controller 118 receives a printer interrupt at block 622, then the method ends at block 624. In this situation, the print job has probably been completed, causing the printer interrupt, or there may be another reason for the printer interrupt.

Referring again to decision blocks 620 and 622, if all the ink valves 112 do not remain open at block 620 (i.e., if one or more ink valves close during printing), then the controller 118 resets the timer T1 and restarts the air pump 102, at blocks 626 and 602, respectively.

Referring again to decision block 614, if all the ink valves 112 are not open, then the controller 118 checks the air pump motor load through the air pump motor feedback signal mechanism 104, as shown at decision block 628. The motor feedback signal may originate from a motor encoder, a back EMF measurement, a measurement of the air pump motor's current, or a measurement of the pulse width modulation (PWM) delivered to the motor by the printer's electronics. In any case, the motor feedback signal enables the controller 118 to determine if the air pump motor is experiencing a load which would indicate a higher system pressure. If the motor is experiencing a substantial load, the controller 188 determines that the system 100 is operating at or above the desired pressure, so the air pump 102 is turned off, as shown at block 630. In this case, the controller 118 determines there is an out of ink condition in one or more ink supplies 106. At block 632, the controller 118 evaluates the ink valve switches 114 to determine which valves 112 are closed. The controller 118 concludes that the ink supplies 106 associated with closed ink valves 112 are empty supplies. Thus, at block 634, the controller 118 informs the user of an out of ink condition with respect to the ink supply or supplies 106 associated with whichever ink valves 112 are closed. The method 600 then ends at block 624.

Referring again to decision block 628, if the air pump motor is not experiencing a high load, then the controller 118 checks for printer interrupts at decision block 636. If there is no printer interrupt at block 636, then the controller 118 begins the method 600 again at decision block 606. If there is a printer interrupt at block 636, then the method 600 ends at block 624.

Fifth Illustrative Embodiment

Figure 7:
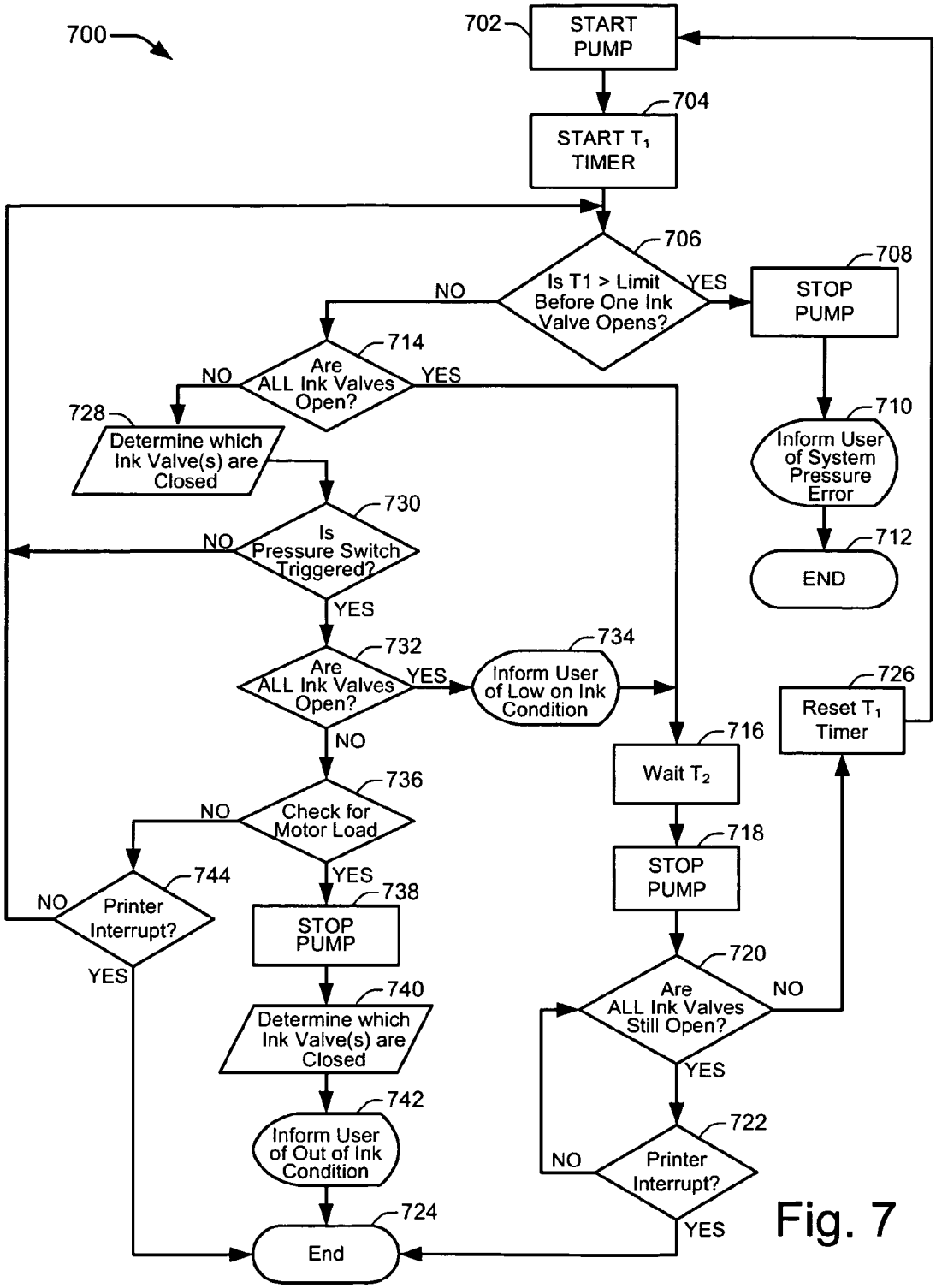
FIG. 7 shows a flowchart of another method of regulating an ink supply system according to an embodiment.

FIG. 7 shows a flowchart of a method 700 of regulating an ink supply system 100 according to an embodiment. Method 700 is associated with the ink delivery system 100 of FIG. 4 and the execution of algorithm 402 on processor 120 to manage the controller 118 in regulating the ink supply system 100, as discussed briefly above. Method 700, through the execution of algorithm 402 on processor 120, operates to determine a normal ink condition, an out of ink condition, a low ink condition and a system pressure problem existing within ink delivery system 100, and to regulate air pump 102 accordingly. References made to ink delivery system 100 in the following description of method 700 therefore refer to the FIG. 4 embodiment of ink delivery system 100.

Referring to FIG. 7, method 700 begins at block 702 when the air pressure source (e.g., air pump) 102 is turned on, for example by controller 118 executing a firmware command when a host printer receives a print job. At the same time, as shown at block 704, a timer is started to keep track of an elapsed time T1. At decision block 706, controller 118 determines whether the elapsed time T1 has exceeded a preset time limit before an ink valve 112 has opened. The preset time limit is typically determined based on the torque of the air pump motor 102 and the current protection mechanisms in the pump motor 102 that limit the amount of time the pump can run on a continuous basis.

In making its determination at decision block 706, the controller 118 monitors a plurality of ink valve switches 114 within respective ink valves 112 and receives an "open signal" from a switch 114 when the switch senses the opening of its respective ink valve 112. The "open signal" is typically indicated by a closure of the switch 114, but may also be indicated by an opening of the switch 144, depending on the switch configuration. At block 706, if controller 118 determines that the elapsed time T1 has exceeded the preset limit before even one ink valve opens, then the air pump 102 is stopped, as shown at block 708. The user is then informed of a system pressure error at block 710. A system pressure error indicates a system pressure problem that may be caused by a leak in a hose (e.g., air tubing 108) or by a hose that has become unattached and is open, etc. After the user is informed of the system pressure error, the method 700 ends at block 712.

Referring again to decision block 706, if controller 118 determines that the elapsed time T1 has not exceeded the preset limit before even one ink valve opens, then the controller 118 checks all the ink valve switches 114 for "open signals" to determine if all the ink valves 112 are open, as shown at decision block 714. If all the ink valves 112 are open then the controller 118 determines that a normal ink condition exists within system 100, and it waits an additional period of time T2 and stops the air pump 102, as shown at blocks 716 and 718, respectively. The controller 118 then performs a loop between decision block 720 and decision block 722, continually checking to see if all the ink valves 112 are still open while also checking for a printer interrupt. If all the ink valves 112 remain open at block 720 and the controller 118 receives a printer interrupt at block 722, then the method ends at block 724. In this situation, the print job has probably been completed, causing the printer interrupt, or there may be another reason for the printer interrupt.

Referring again to decision blocks 720 and 722, if all the ink valves 112 do not remain open at block 720 (i.e., if one or more ink valves close during printing), then the controller 118 resets the timer T1 and restarts the air pump 102, at blocks 726 and 702, respectively.

Referring again to decision block 714, if all the ink valves 112 are not open, then the controller 118 determines which ink valves 112 are closed at block 728. At decision block 730, the controller 118 then checks to see if the pressure switch 400 has been triggered. Pressure switch 400 provides a trigger (e.g., closes) when air pressure in air tubing 108 reaches a preset system air pressure threshold. If the pressure switch 400 has not been triggered, then the controller 118 continues the method at decision block 706, as discussed above. If the pressure switch 400 has been triggered, however, then the controller 118 checks if all the ink valves 112 are open at decision block 732. If all ink valves are open, the controller 118 concludes there is a low ink condition in the ink supply or supplies 106 associated with the ink valve or valves 112 determined at block 728 to have been closed. The controller 118 then informs the user of the low ink condition at block 734 and the method 700 continues at block 716 as discussed above.

Referring again to decision block 732, if all the ink valves 112 are not open, then the controller 118 checks the air pump motor load through the air pump motor feedback signal mechanism 104, as shown at decision block 736. The motor feedback signal may originate from a motor encoder, a back EMF measurement, a measurement of the air pump motor's current, or a measurement of the pulse width modulation (PWM) delivered to the motor by the printer's electronics. In any case, the motor feedback signal enables the controller 118 to determine if the air pump motor is experiencing a load which would indicate a higher system pressure. If the motor is experiencing a substantial load, the controller 188 determines that the system 100 is operating at or above the desired pressure, so the air pump 102 is turned off, as shown at block 738. In this case, the controller 118 determines there is an out of ink condition in one or more ink supplies 106. At block 740, the controller 118 evaluates the ink valve switches 114 to determine which valves 112 are closed. The controller 118 concludes that the ink supplies 106 associated with closed ink valves 112 are empty supplies. Thus, at block 742, the controller 118 informs the user of an out of ink condition with respect to the ink supply or supplies 106 associated with whichever ink valves 112 are closed. The method 700 then ends at block 724.

Referring again to decision block 736, if the air pump motor is not experiencing a high load, then the controller 118 checks for printer interrupts at decision block 744. If there is no printer interrupt at block 744, then the controller 118 begins the method 700 again at decision block 706. If there is a printer interrupt at block 744, then the method 700 ends at block 724.

Sixth Illustrative Embodiment

Figure 8:
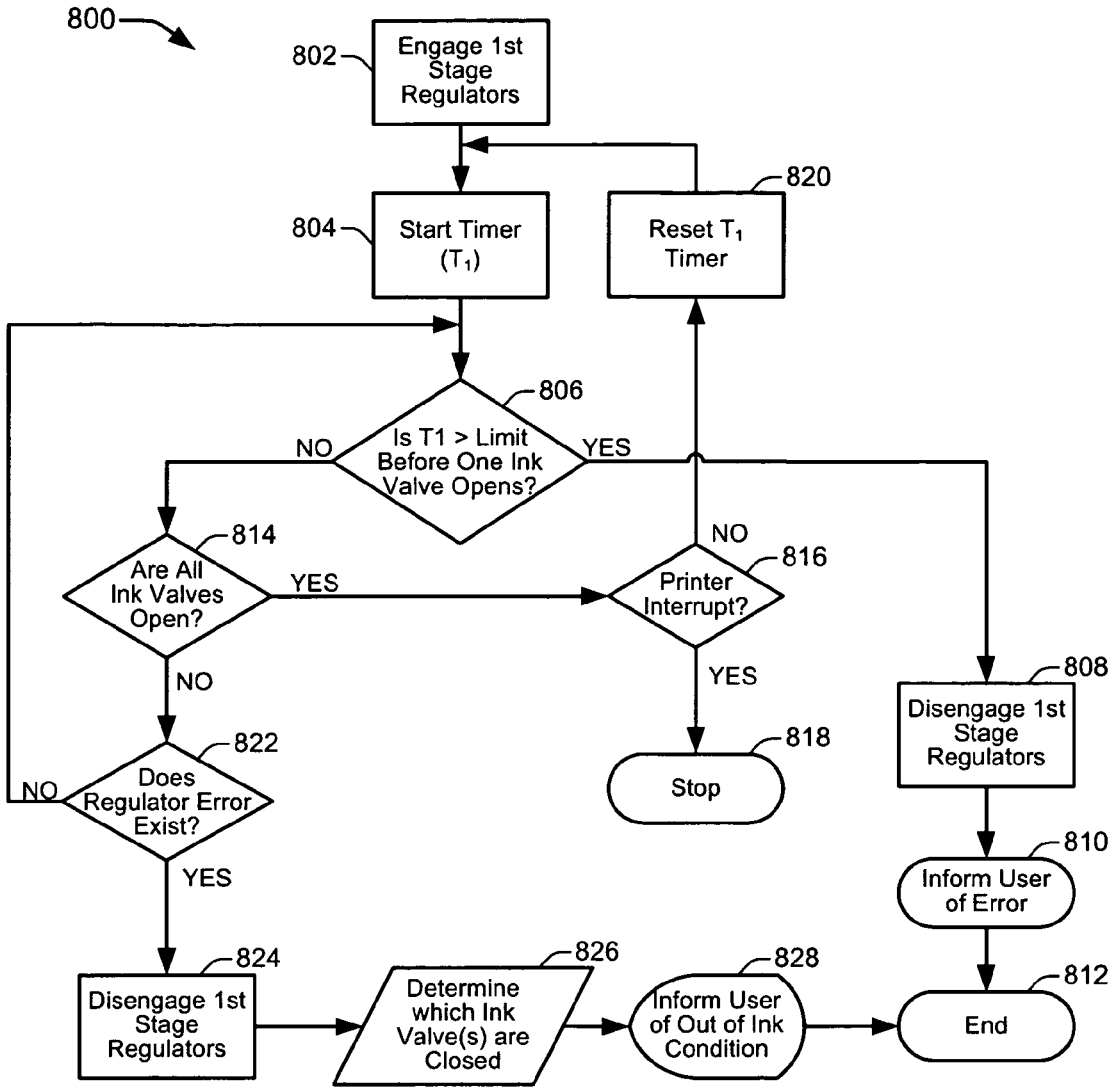
FIG. 8 shows a flowchart of another method of regulating an ink supply system according to an embodiment.

FIG. 8 shows a flowchart of a method 800 of regulating an ink supply system 100 according to an embodiment. Method 800 is associated with the ink delivery system 100 of FIG. 5 and the execution of algorithm 502 on processor 120 to manage the controller 118 in regulating the ink supply system 100, as discussed briefly above. Method 800, through the execution of algorithm 502 on processor 120, operates to determine a normal ink condition, an out of ink condition and a system pressure problem due to regulator error, existing within self-pressurized ink supplies 210 of ink delivery system 100, and to regulate air pressure accordingly through control of first stage regulators 500. References made to ink delivery system 100 in the following description of method 800 therefore refer to the FIG. 5 embodiment of ink delivery system 100.

Referring to FIG. 8, method 800 begins at block 802 when the first stage regulators 500 are engaged, for example by controller 118 executing a firmware command when a host printer receives a print job. At the same time, as shown at block 804, a timer is started to keep track of an elapsed time T1. At decision block 806, controller 118 determines whether the elapsed time T1 has exceeded a preset time limit before an ink valve 112 has opened.

In making its determination at decision block 806, the controller 118 monitors a plurality of ink valve switches 114 within respective ink valves 112 and receives an "open signal" from a switch 114 when the switch senses the opening of its respective ink valve 112. The "open signal" is typically indicated by a closure of the switch 114, but may also be indicated by an opening of the switch 144, depending on the switch configuration. At block 806, if controller 118 determines that the elapsed time T1 has exceeded the preset limit before even one ink valve opens, then the regulators 500 are disengaged, as shown at block 808. The user is then informed of a system pressure error at block 810. A system pressure error indicates a system pressure problem that may be caused by a leak in a hose (e.g., air tubing 108), by a hose that has become unattached and is open, or by a regulator 500 malfunction. After the user is informed of the system pressure error, the method 800 ends at block 812.

Referring again to decision block 806, if controller 118 determines that the elapsed time T1 has not exceeded the preset limit before even one ink valve opens, then the controller 118 checks all the ink valve switches 114 for "open signals" to determine if all the ink valves 112 are open, as shown at decision block 814. If all the ink valves 112 are open then the controller 118 determines that a normal ink condition exists within system 100, and it checks for a printer interrupt at block 816. If the controller 118 receives a printer interrupt at block 816, then the method ends at block 818. In this situation, a printer interrupt likely indicates the print job has been completed, or there may be another reason for the printer interrupt. If there is no printer interrupt at block 816, the controller 118 resets the timer T1 at block 820 and begins the method 800 again at block 804.

Referring again to decision block 814, if all the ink valves 112 are not open, then the controller 118 determines if there is a regulator 500 error at decision block 822. If there is no regulator error, the controller 118 begins the method 800 again at decision block 806. If there is a regulator error, however, the controller 118 disengages the regulators 500 as shown at block 824, and determines which ink valves 112 are closed at block 826. At block 828, the controller then informs the user that there is an out of ink condition with respect to those self-pressurized ink supplies 210 associated with those ink valves 112 determined to be closed at block 826. The method 800 then ends at block 812.

Seventh Illustrative Embodiment

Figure 9:
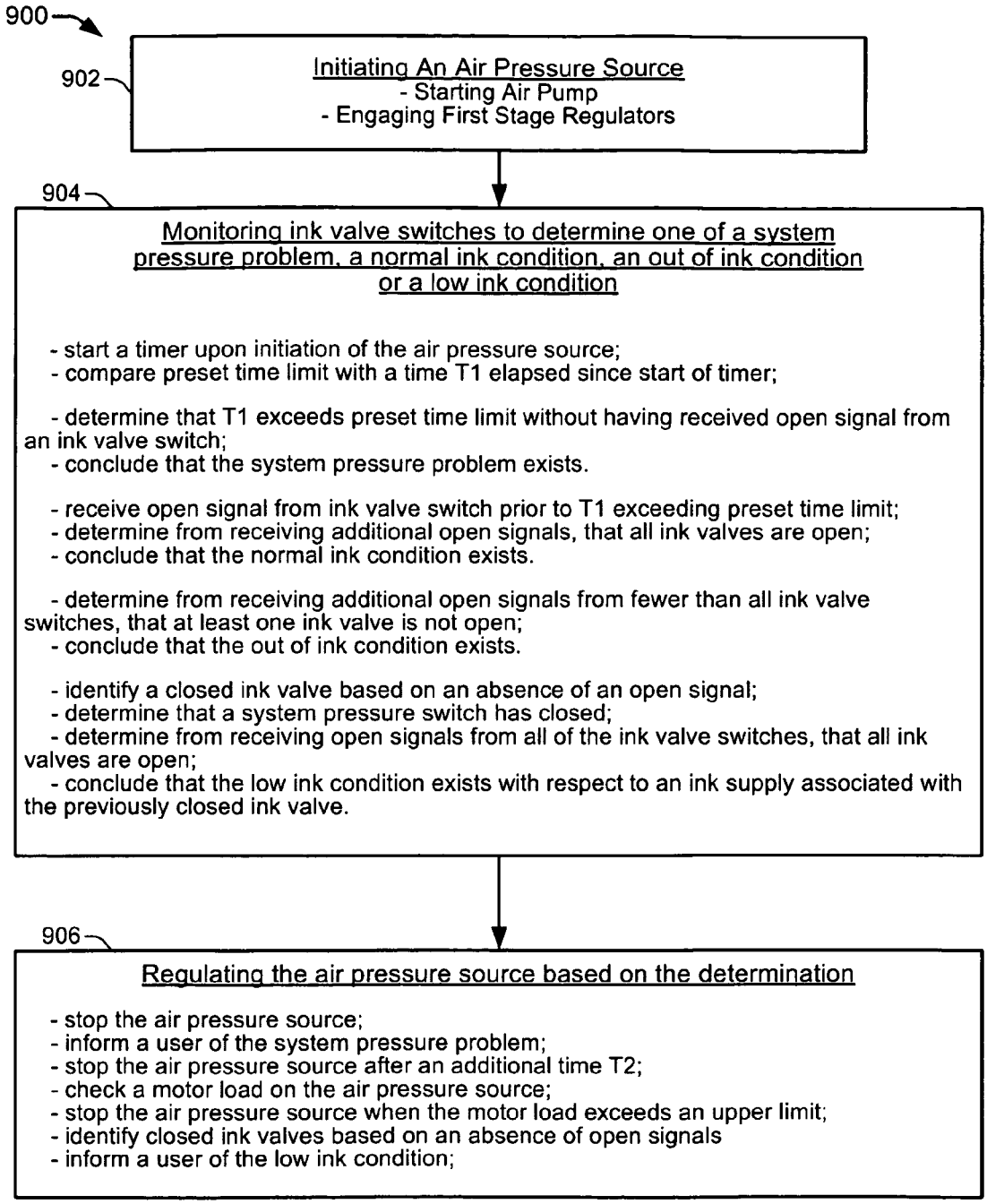
FIG. 9 shows a flowchart of another method of regulating an ink supply system according to an embodiment.

FIG. 9 shows a flowchart of a general method 900 of regulating an ink supply system 100 according to an embodiment. Method 900 generally encompasses methods 600, 700 and 800 discussed above and is therefore generally associated with the ink delivery systems 100 of FIGS. 1, 4 and 5, and the execution of algorithms 124, 402 and 502 on processor 120 to manage the controller 118 in regulating the ink supply system 100. Method 900, through the execution of algorithms 124, 402 and 502 on processor 120, operates to determine a normal ink condition, an out of ink condition, a low ink condition and a system pressure problem existing within ink supplies 106 and 210 of ink delivery system 100, and to regulate air pressure accordingly. References made to ink delivery system 100 in the following description of method 900 therefore may refer to any of the embodiments of the ink delivery systems 100 illustrated in FIGS. 1, 4 and 5.

Referring to FIG. 9, method 900 begins at block 902 with initiating an air pressure source. As shown at block 902, initiating an air pressure source can include any starting of an air pressure source already discussed above with respect to the methods of FIGS. 6-8, such as, starting an air pump or engaging first stage regulators. Method 900 continues at block 904 with monitoring ink valve switches to determine one of a system pressure problem, a normal ink condition, an out of ink condition or a low ink condition. Monitoring may include any of the various steps already noted above with respect to the methods of FIGS. 6-8, such as, starting a timer upon initiation of the air pressure source, comparing a preset time limit with a time T1 elapsed since start of timer, determining that T1 exceeds the preset time limit without having received an open signal from an ink valve switch, concluding that the system pressure problem exists, receiving an open signal from an ink valve switch prior to T1 exceeding the preset time limit, determining from receiving additional open signals that all ink valves are open, concluding that the normal ink condition exists, determining from receiving additional open signals from fewer than all ink valve switches that at least one ink valve is not open, concluding that the out of ink condition exists, identifying a closed ink valve based on an absence of an open signal, determining that a system pressure switch has closed, determining from receiving open signals from all of the ink valve switches, that all ink valves are open, concluding that the low ink condition exists with respect to an ink supply associated with the previously closed ink valve.

Method 900 continues at block 906 with regulating the air pressure source based on the determination. Regulating may include any of the various steps already noted above with respect to the methods of FIGS. 6-8, such as, stopping the air pressure source, informing a user of the system pressure problem, stopping the air pressure source after an additional time T2, checking a motor load on the air pressure source, stopping the air pressure source when the motor load exceeds an upper limit, identifying closed ink valves based on an absence of open signals, informing a user of the low ink condition.

What is claimed is:

1. An ink delivery system, comprising:

a plurality of ink supplies;

an air pressure source to generate ink pressure for each ink supply;

an ink valve associated with each ink supply, each ink valve configured to prevent a reverse flow of ink from a pen to the associated ink supply, and each ink valve comprising a switch configured to provide an open signal when the ink valve is open;

a system pressure switch configured to close when system air pressure from the air pressure source reaches a threshold; and a controller configured to determine a low ink condition in an ink supply when a corresponding ink valve opens after the system pressure switch closes, and to determine one of a normal ink condition, an out of ink condition or a system pressure problem based on receiving the open signals and to regulate the pressure source according to the determination.

2. An ink delivery system as in claim 1, wherein each ink valve comprises a diaphragm configured to close the switch upon encountering a predetermined ink pressure which displaces the diaphragm.

3. An ink delivery system as in claim 2, wherein each ink valve further comprises a spring supporting the diaphragm and configured to deflect when the diaphragm encounters the predetermined ink pressure, the deflection permitting the displacement of the diaphragm.

4. An ink delivery system as in claim 2, wherein each ink valve further comprises an ink inlet port and an ink outlet port, and wherein a seal on the diaphragm blocks the ink outlet port to prevent ink from flowing to the pen until the diaphragm is displaced, opening the seal.

5. An ink delivery system as in claim 1, wherein the air pressure source is a plurality of air pressure sources, each air pressure source configured as part of a respective ink supply, each ink supply thereby being a self-pressurized ink supply, and wherein the controller is configured to regulate each air pressure source based on the determination of a normal ink condition, an out of ink condition or a system pressure problem.

* * * * *